United States Patent [19]

Tenney et al.

[11] 4,013,127

[45] Mar. 22, 1977

[54] FIRE EXTINGUISHER PACKAGE FOR WASTE RECEPTACLE

[75] Inventors: Kenneth S. Tenney; Michael A. Roby, both of Winchester, Va.

[73] Assignee: Rubbermaid Commercial Products, Inc., Winchester, Va.

[22] Filed: Jan. 22, 1975

[21] Appl. No.: 543,022

[52] U.S. Cl. ..... 169/57; 169/26; 222/54; 248/205 A

[51] Int. Cl.[2] ..... A62C 35/10

[58] Field of Search ..... 169/26, 51, 56, 57, 169/58, 65; 222/54, 518, 180, 182; 239/274; 248/205 A, 215, 311

[56] References Cited

UNITED STATES PATENTS

| | | | |
|---|---|---|---|
| 1,258,296 | 3/1918 | Zottel | 169/26 |
| 2,498,131 | 2/1950 | Marchell | 169/26 |
| 2,759,546 | 8/1956 | Zabriskie | 169/26 |
| 2,824,614 | 2/1958 | Bowman | 169/26 |
| 2,876,845 | 3/1959 | Boyce | 169/26 |
| 3,367,610 | 2/1968 | Lindquist | 248/205 A X |
| 3,536,139 | 10/1970 | Berti et al. | 169/26 |
| 3,536,287 | 10/1970 | Kramer | 248/215 X |
| 3,704,830 | 11/1971 | Faso | 239/274 |
| 3,796,267 | 3/1974 | Hunter et al. | 169/26 X |
| 3,889,754 | 6/1975 | Dunn | 169/65 X |
| 3,907,037 | 9/1975 | Linsalato et al. | 169/57 |

*Primary Examiner*—John J. Love
*Assistant Examiner*—Michael Mar
*Attorney, Agent, or Firm*—Hamilton, Renner & Kenner

[57] ABSTRACT

A fire extinguisher package or assembly adapted for attachment to the top rim of a waste receptacle. A small translucent plastic container holds pressurized extinguisher liquid and a heat-activated valve for discharging and directing the liquid is connected to the top of the container and enclosed in a protecting shroud. The shroud or a cover therefor is mounted on the receptacle rim by releasable attaching means.

10 Claims, 10 Drawing Figures

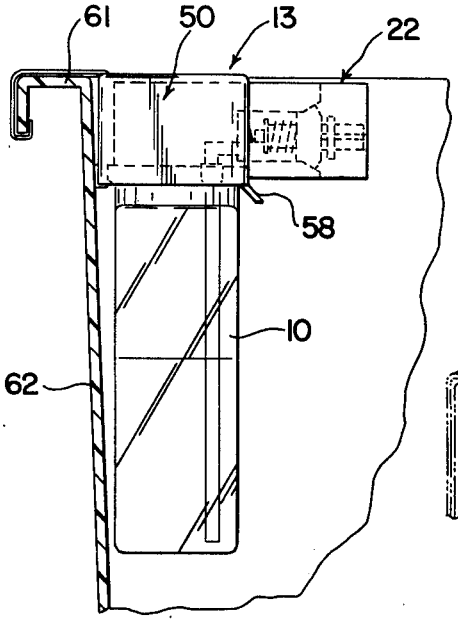
FIG. 1
FIG. 2
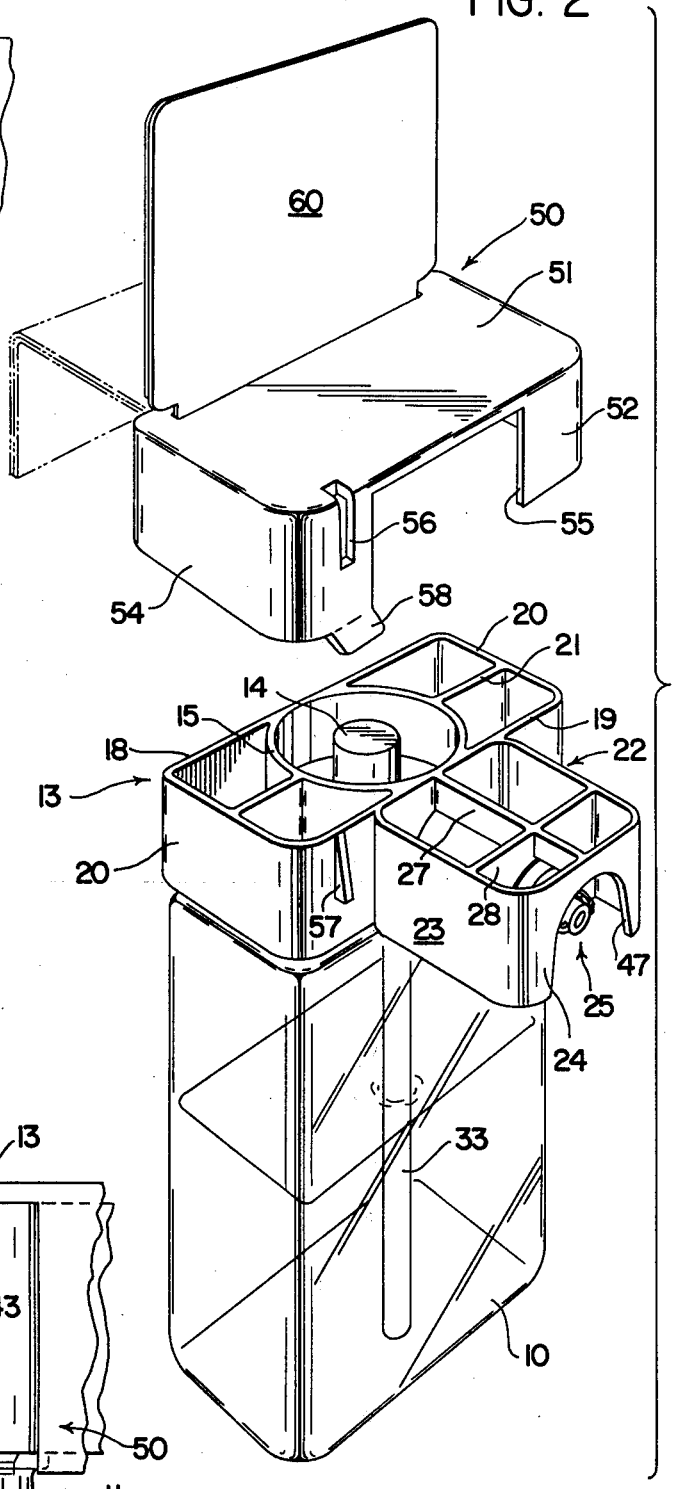
FIG. 6
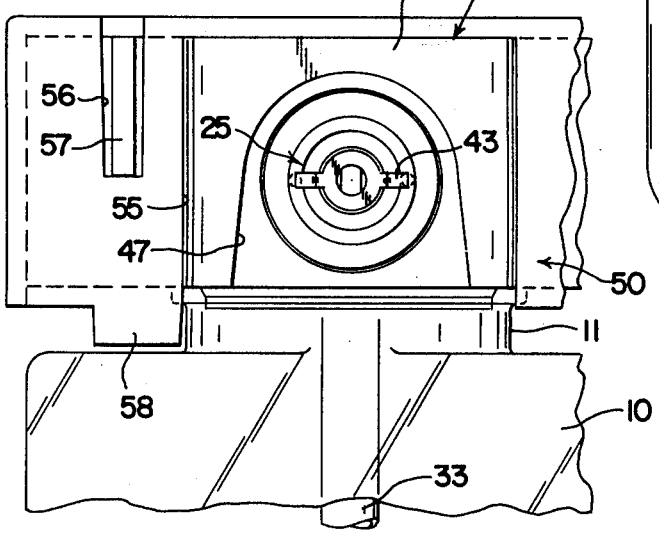

6

FIRE EXTINGUISHER PACKAGE FOR WASTE RECEPTACLE

BACKGROUND OF THE INVENTION

Conventional fire extinguishers have required heavy metal containers holding liquids under high pressures often with gauges to indicate the interior pressure. Such containers have to utilize heavy gauge metal to prevent explosions as the heat increases the liquid pressures, and the extinguishers are consequently heavy and expensive. The use of plastic containers for individual fire extinguishers has not been considered feasible because of the danger of explosions caused by increased internal pressure when subjected to heat.

Automatic sprinkler systems with heat-activated release valves have been provided but these require an expensive system of supply piping and are often not practical for protecting special locations.

It has been proposed to utilize as an individual fire extinguisher a tube or container of thermoplastic resin which melts or softens at a predetermined temperature, the tube being filled with pressurized extinguisher liquid which is discharged at the point the tube is opened. The tube may be conformed to and located within an object to be protected such as a television set. Such a tube or container would not be satisfactory as fire protection for a waste receptacle as the direction of the discharge of extinguisher liquid would not be controlled and might be directed away from the flames in the receptacle.

It has been further proposed to provide an individual fire extinguisher having the extinguisher liquid contained in a thin flexible envelope rupturable by a predetermined heat and/or pressure, but the envelope necessarily has been encased in a rigid outer shell for protection and either the shell must allow access to the envelope to subject it to the exterior heat to rupture the envelope and discharge the extinguisher liquid at the proper time, or an exposed fusible sealing member has been provided for the envelope. Here, again, the direction of discharge of the extinguisher liquid is not adequately controlled

SUMMARY OF THE INVENTION

It is an object of the present invention to provide a novel and improved fire extinguisher package which is peculiarly adapted for attachment to the top of a waste receptacle and is activated by a predetermined temperature generated within the receptacle.

Another object is to provide an improved fire extinguisher package which utilizes a translucent container for extinguisher liquid and has a heat-activated valve for discharging and directing extinguisher liquid into the waste receptacle.

A further object is to provide an improved fire extinguisher package having improved means for quick releasable attachment to the rim of a waste receptacle.

Another object is to provide an improved fire extinguisher package having a heat-activated valve for discharging extinguisher liquid into the receptacle, and which has a shroud for mounting and protecting the valve.

A still further object is to provide an improved fire extinguisher package having a normally open discharge valve held closed by at least one exterior fusible element.

Still another object is to provide an improved fire extinguisher package having a translucent plastic container for fire extinguisher liquid under pressure, and a heat-activated valve normally closing said container and releasable at a predetermined temperature, said container being adapted to soften and perforate at a temperature not less than that required to release the valve.

Finally, it is an object of the present invention to provide an improved fire extinguisher package which is simple, lightweight and inexpensive, and which accomplishes all of the foregoing objects.

Various modifications and changes in details of construction are comprehended within the scope of the appended claims.

BRIEF DESCRIPTION OF THE DRAWINGS

FIG. 1 is a side elevation of a preferred embodiment of the improved fire extinguisher assembly detachably mounted on the inside of the top rim of a waste receptacle shown in cross section.

FIG. 2 is an enlarged exploded perspective view of the fire extinguisher assembly.

FIG. 6 is a fragmentary elevational view on line 6—6 of FIG. 4.

DESCRIPTION OF PREFERRED EMBODIMENTS

Figure 3:
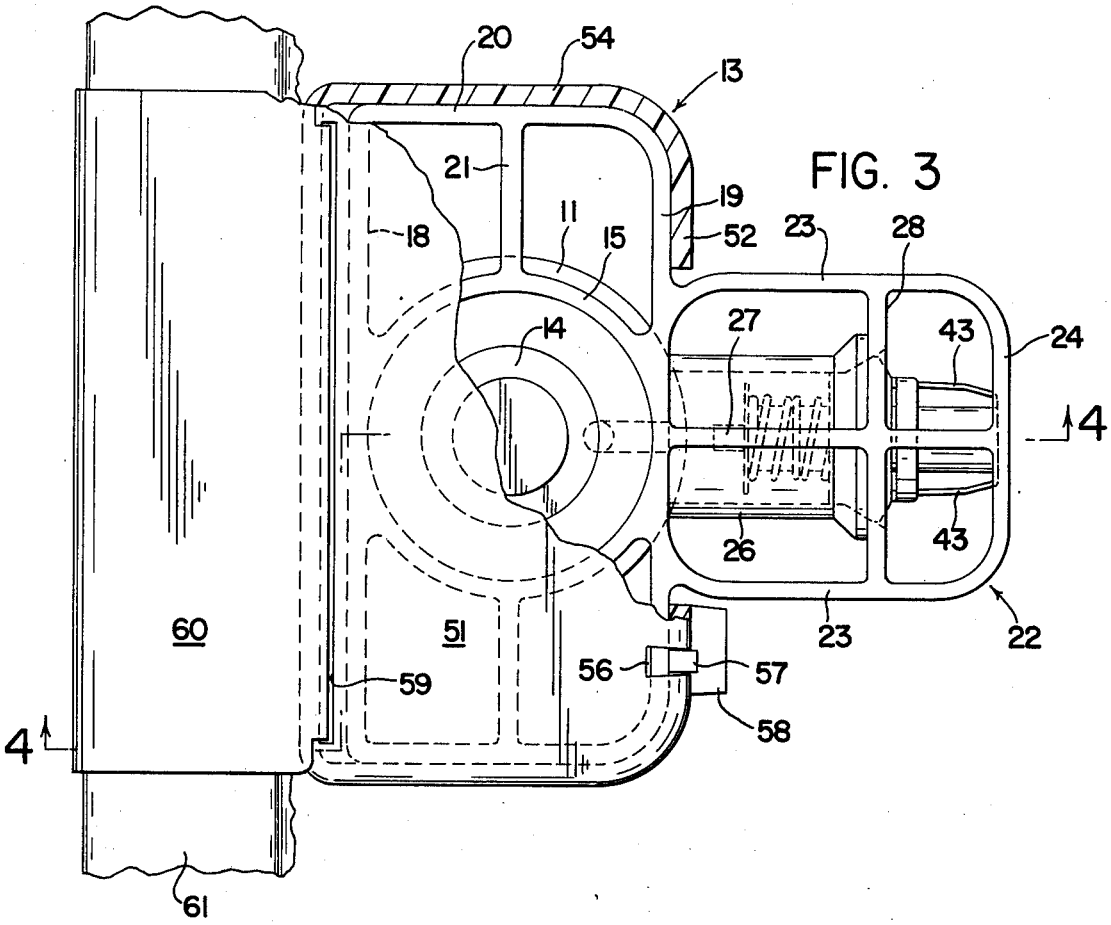
FIG. 3 is an enlarged fragmentary plan elevation, partly broken away and in section, of the improved fire extinguisher assembly mounted on the top rim of a receptacle, as in FIG. 1.

The improved fire extinguisher assembly comprises a transparent or translucent bottle for the extinguisher fluid, a shroud embodying a sealed closure for the bottle and enclosing a heat-activated valve for discharging the fluid, and a hanger-cover for detachably mounting the shroud on the top rim of a waste receptacle. Substantially all of these parts are desirably made of lightweight plastic material.

Referring to the drawings, the bottle 10 may be rectangular as shown or may be circular in cross section or irregular in shape, as desired. The plastic material may be an acetal plastic such as is known by the trademark "CELCON" sold by Celanese Corp., or may be a polyester known as "VALOX" sold by General Electric Co., although other plastic materials may be used which are transparent or translucent, which are normally impervious to the extinguisher fluid but which soften and become pervious at a predetermined temperature. The extinguisher fluid may be a halogenated hydrocarbon which is self-pressurizing under heat, as for example the liquid known by the trade name "FREON."

Figure 4:
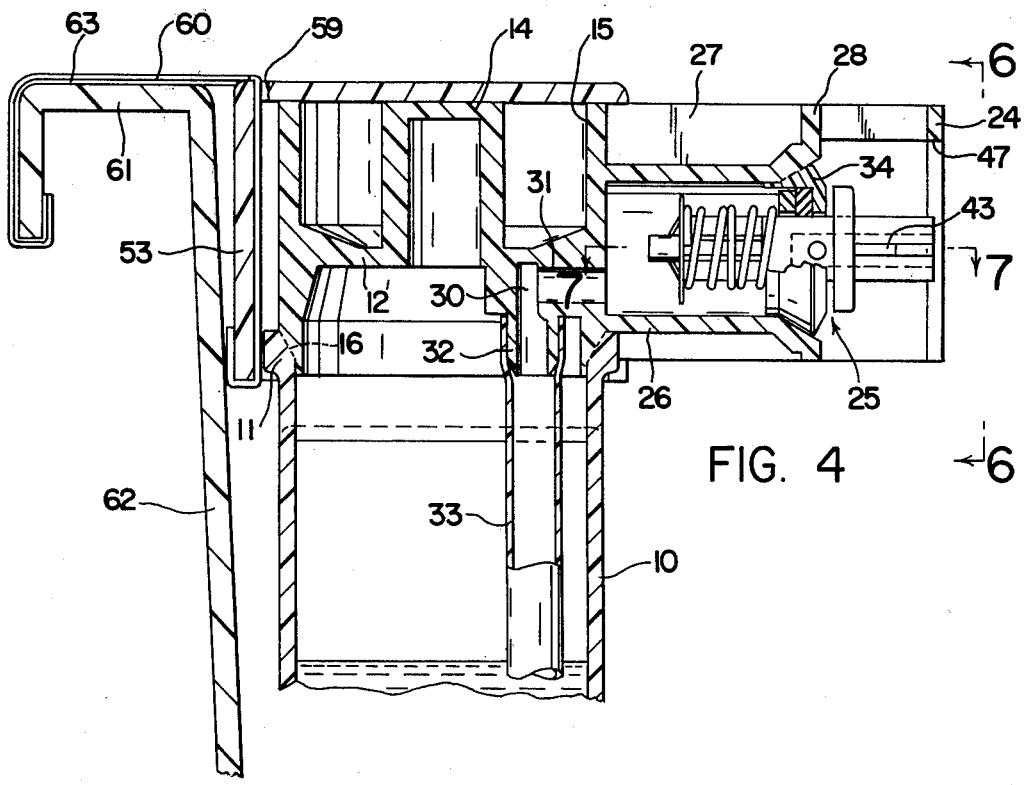
FIG. 4 is a sectional view on line 4—4 of FIG. 3, showing the heat-activated valve closed.

As shown in FIG. 4, the bottle 10 has a neck portion 11 at its upper end and a closure cap 12, which is preferably part of the shroud indicated as a whole at 13, is sealed into the neck 11. The cap portion preferably includes a tubular projection 14 surrounded by an upwardly projecting annular wall 15 which provides an annular opening for entering the end of an ultrasonic welding tool for making a fused seal 16 between the cap and the neck. The material of the shroud 13 may be the same as that of the bottle or another plastic material which is compatible therewith.

The shroud 13 preferably has a substantially rectangular outer wall including rear wall portions 18 and front wall portions 19 integral with said annular wall 15, and side wall portions 20 connected to said annular wall 15 by integral ribs 21. Projecting forwardly from front wall portions 19 and integral therewith is a substantially rectangular front shroud portion indicated generally at 22 having integral side walls 23 and a front wall 24.

As shown, a heat-activated valve unit indicated generally at 25 is mounted in a tubular socket 26 formed medially of the shroud portion 22 and integrally connected at its rear end with annular wall 15. The socket 26 is connected to the side walls 23 and front wall 24 by intersecting integral ribs 27 and 28. Thus, the shroud protects the valve unit 25 from accidental damage or discharge, embodies the closure cap sealing the bottle, and mounts the nozzle in a position angular to the longitudinal axis of the bottle so as to direct the extinguisher liquid over the fire.

Figure 5:
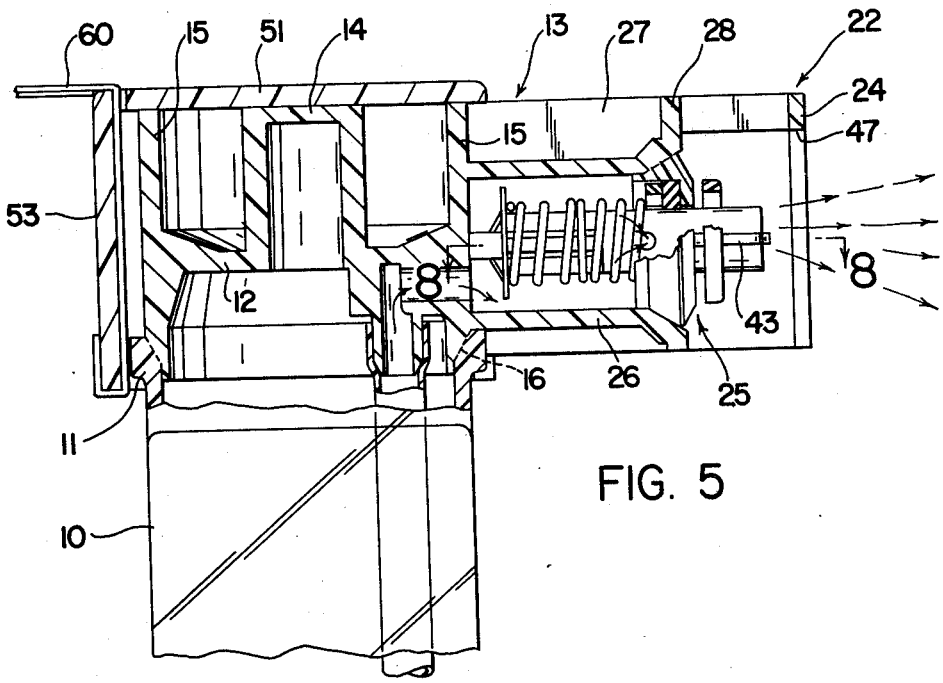
FIG. 5 is a similar view showing the valve activated to open position.

As seen in FIGS. 4 and 5, a port 30 in the closure cap 12 communicating with the interior of bottle 10 intersects a port 31 communicating with the interior of socket 26. The port 30 preferably extends through a tubular projection 32 for attaching a liquid supply tube 33 which extends below the liquid level in bottle 10 near the bottom thereof.

Figure 7:
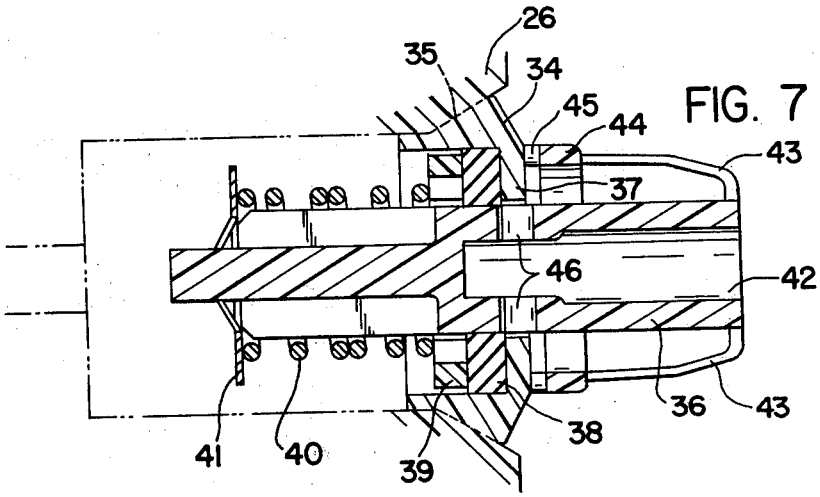
FIG. 7 is a plan sectional view on line 7—7 of FIG. 4.

The embodiment of the valve shown by way of example at 25 includes a cup member 34 of plastic material identical to or compatible with the material of the shroud, preferably having a beveled annular exterior surface which is sealed at 35 (FIG. 7) to the beveled open end of the socket as by ultrasonic welding.

A valve stem 36 is axially movable through a central aperture in the outer wall 37 of cup member 34 and a sealing gasket 38 of rubber or the like surrounds the stem and abuts the underside of cup wall 37. Abutting the underside of gasket 38 is a rigid annular washer 39 preferably having notches around its inner periphery. One end of a helical compression spring 40 encircling the inner portion of the stem abuts washer 39, and the other end is retained by a rigid abutment washer 41 secured on the inner end of the stem. Preferably, that portion of the stem within the spring is cruciform, at least in part, to save material.

Thus, the spring 40 yieldingly urges the stem 36 inwardly of the cup 34 while holding the gasket 38 in sealing contact with the stem and cup wall 37.

The outer end portion of the stem 36 has a bore or nozzle opening 42 therein, and at least two thin links 43 connect the outer end of the stem with a circular ring 44 having spaced projections 45 abutting the wall 37 of the cup. Near the bottom of the bore 42 are lateral connecting ports 46 opening through the stem, and the links 43 normally hold the stem in the valve closed position in FIGS. 4 and 7, in which th ports 46 are on the outside of the gasket 38 and hence sealed off from the socket. The stem and the links 43 are constructed of plastic material, preferably "CELON" which will begin to soften on approaching its melting point of 330° F., and the cross section of the links is such that they will collapse in about 5–10 seconds when subjected to temperatures at and exceeding that temperature.

Figure 8:
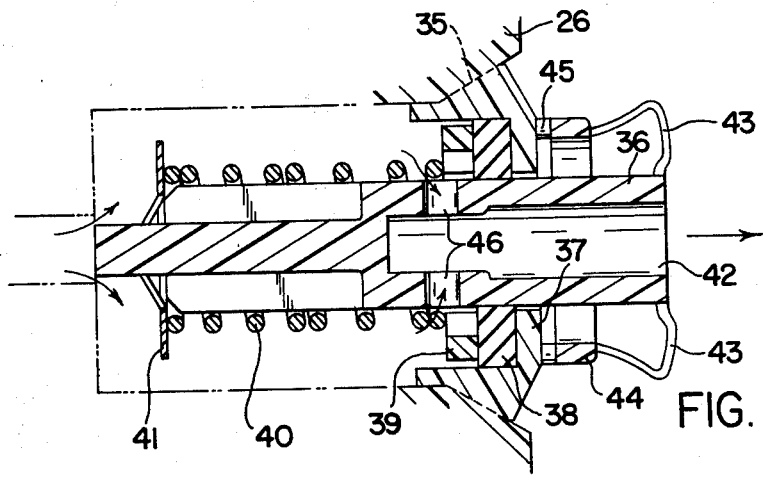
FIG. 8 is a plan sectional view on line 8—8 of FIG. 4.

When the links collapse, as shown in FIGS. 5 and 8, the spring 40 moves the stem inwardly until its inner end abuts the bottom of socket 26, and this moves the lateral ports 46 to the inside of sealing gasket 38 where they provide communication between the interior of bottle 10 and the nozzle opening 42 and allow discharge of the fire extinguisher liquid therefrom, a notch 47 being provided in the front shroud wall 24 in front of the nozzle.

An embodiment of a hanger-cover for detachably mounting the shroud on the upper rim of a refuse container is indicated as a whole at 50 and has a top wall 51 with depending peripheral walls, namely, a front wall 52, rear wall 53 and side walls 54. The top wall 51 is adapted to fit over the main shroud 13 and the front wall 52 has a notch 55 therein for fitting around the front shroud portion 22, as seen in FIG. 6.

The hanger-cover 50 is adapted to be snapped over the shroud and for this purpose a vertical slot 56 is provided in front wall 52 for fitting over and engaging under the bottom of a vertical triangular leg 57 on the front wall of the main shroud. A finger-engaging lip flange 58 is provided on the bottom of the front wall 52 for lifting the cover.

Adjacent the rear wall 53, the top wall 51 is provided with a slot 59 parallel thereto, and a bendable sheet or tab of soft metal 60, with its lower end snubbed around the bottom edge of rear wall 53, extends upwardly through the slot, as best shown in FIG. 2. The upper protruding portion of the metal tab 60 is quickly and easily bent downwardly over the upper rim 61 of a refuse container indicated fragmentarily at 62. The rear surface of the protruding tab 60, as viewed in FIG. 2, may have a coextensive sheet of double-faced adhesive 63 attached thereto with its outer surface masked, so that when the tab is bent over the container rim the masking may be peeled off and the sheet adhered to the rim.

In the operation of the novel and improved fire extinguisher assembly, it is easily attached to the inside of a waste receptacle as shown, with the bottle partially filled with extinguisher liquid, the level of which can be seen through the walls of the bottle. In this position the nozzle of the valve 25 is directed horizontally over and above the contents of the receptacle. In the event the contents catch fire the heat therefrom can circulate freely upward through the shroud portion 22 and around the heat-activated links 43, causing them to collapse in a few seconds and discharge a blanket of extinguisher liquid over top of the first and quickly extinguish it. Once the bottle has been discharged, a glance at the bottle indicates that fact and the bottle and shroud can be snapped out of the hanger-cover and a new bottle and shroud reinserted if the waste receptacle is reusable.

In the unlikely event that the valve 25 malfunctions and fails to open when exposed to the fire, the wall of the plastic bottle will soften by exposure to the heat and will perforate or "pinhole" a short time aftr the intended activation of the valve, as determined by the relative thickness of the bottle walls, and allow the extinguisher fluid to leak out. This will usually serve to extinguish the fire even though the discharge is not guided in the optimum direction. In any event, there can be no explosion caused by a substantial build-up of pressure within the bottle as in the case with metal bottles.

Figure 9:
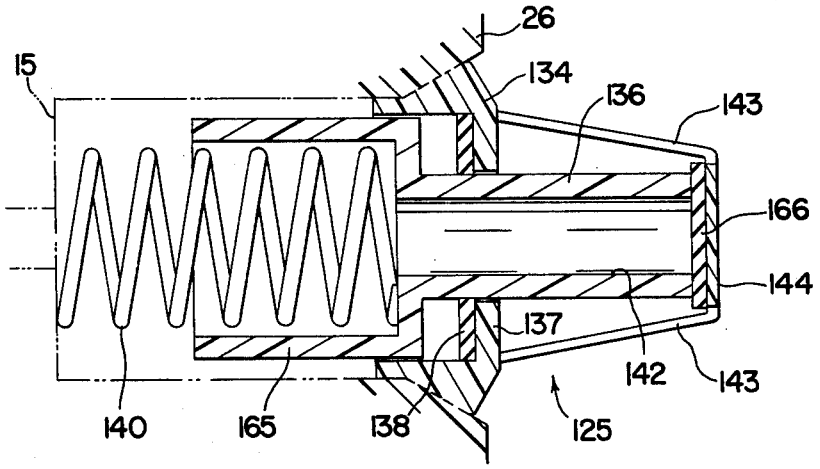
FIG. 9 is a plan sectional view similar to FIG. 7 of another embodiment of a heat-activated valve in closed position.

The embodiment of a heat-activated valve indicated generally at 125 in FIG. 9 is mounted in the tubular socket 26 in the shroud portion 22 which is integrally connected at its rear end with annular wall 15. The valve 125 has a cup member 134 which is sealed to the beveled open end of the socket by ultrasonic welding.

The valve stem 136 is axially movable through a central aperture in the outer wall 137 of cup member 134 and a sealing gasket 138 of rubber or the like surrounds the cup and abuts the underside of cup wall 137. The stem 136 has a cup member 165 on its inner end and a helical compression spring 140 is located within the cup member 165 and is interposed between the wall 15 and the closed end of the cup 165 for urging the valve stem outwardly.

The outer end portion of stem 136 is tubular forming a nozzle opening 142 therein which is closed by an outer gasket 166. The gasket is normally held in sealing abutment with the outer end of the stem by a circular disk 144 which is connected to the cup member 134 by at least two thin links 143 of plastic material such as "CELCON" which will begin to soften at approaching 330° F. and which will melt and collapse in about 5–10 seconds when subjected to temperatures at and exceeding 330° F.

When the links 143 melt, the internal pressure of the extinguisher liquid aided by the spring will force the stem outwardly moving the gasket 166 away from the end of the stem and opening the nozzle 142. Normally, the spring 140 maintains sufficient force against the gasket 166 to compensate for plastic creep of the links and maintain the gasket in sealing abutment with the end of the stem.

Figure 10:
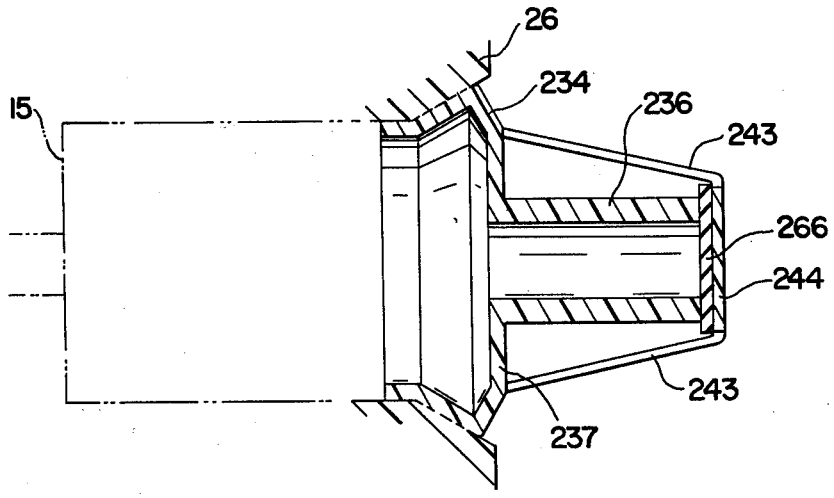
FIG. 10 is a plan sectional view similar to FIG. 7 of still another embodiment of a heat-activated valve in closed position.

The embodiment of a heat-activated valve indicated generally at 225 in FIG. 10 does not have a movable valve stem but a tubular stem 236 is formed on the wall 227 of cup member 234 which is ultrasonically welded in socket 26. The outer end of the stem 236 is closed by a gasket 266 normally held in sealing abutment with the stem by a disk 244 connected to the cup member 234 by at least two thin links 243 of heat softenable plastic material such as "CELCON."

The internal pressure on the larger area of wall 237 of the cup member normally compensates for plastic creep.

The novel and improved fire extinguisher assembly is quickly attached to and detached from the upper rim of waste receptacles of various sizes and shapes, employs as a safety feature a plastic extinguisher bottle adapted to release the liquid therein in the event that the heat-activated valve malfunctions, and is lightweight and inexpensive, being made entirely of plastic material, except for the valve spring and attaching tab.

We claim:

1. A fire extinguisher assembly adapted for attachment to the upper rim of a waste receptacle comprising, a see-through plastic container for fire extinguisher liquid, a shroud member surrounding one end of the container and sealing the container, a heat-activated valve mounted in said shroud laterally of the container and normally closing said container for discharging extinguisher liquid therefrom at a predetermined temperature and in a predetermined direction, and means for releasably attaching said container to the upper rim of a waste receptacle, said plastic container adapted to soften and perforate at a temperature slightly greater than that required to open the valve.

2. A fire extinguisher assembly as described in claim 1, wherein the releasable attaching means comprises a bendable plate on the container assembly releasably attachable to the rim of the waste receptacle.

3. A fire extinguisher assembly as described in claim 1, wherein a shroud member seals the container and the valve is mounted in said shroud.

4. A fire extinguisher assembly as described in claim 4, wherein a cover is releasably attached to the shroud member and to the upper rim of the waste receptacle.

5. A fire extinguisher assembly as described in claim 1, wherein the heat-activated valve has at least one heatsoftenable link for allowing opening movement of the valve.

6. A fire extinguisher assembly as described in claim 5, wherein spring means is provided to open the valve when the link is softened by heat.

7. A fire extinguisher assembly adapted for attachment to the upper rim of a waste receptacle comprising, a see-through plastic container for fire extinguisher liquid, a shroud member surrounding one end of the container and sealing the container, a heat-activated valve mounted in said shroud laterally of the container and normally closing the container for discharging extinguisher liquid therefrom at a predetermined temperature and in a predetermined direction, and a bendable plate on the container assembly adhesively attachable to the rim of the waste receptacle.

8. A fire extinguisher assembly as described in claim 7, wherein the valve is mounted in said shroud at an angle to the longitudinal axis of the container.

9. A fire extinguisher assembly as described in claim 7, wherein a cover is releasably attached to the shroud member and a bendable plate on the cover is adhesively attachable to the rim of the waste receptacle.

10. A fire extinguisher assembly as described in claim 9, wherein the valve is mounted in said shroud at an angle to the longitudinal axis of the container.

* * * * *